US008843002B2

(12) United States Patent
Bonino et al.

(10) Patent No.: US 8,843,002 B2
(45) Date of Patent: Sep. 23, 2014

(54) METHOD OF CORRELATING IMAGE MISREGISTRATION

(75) Inventors: Paul S Bonino, Ontario, NY (US); David A Mueller, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 799 days.

(21) Appl. No.: 13/076,524

(22) Filed: Mar. 31, 2011

(65) Prior Publication Data

US 2012/0251132 A1 Oct. 4, 2012

(51) Int. Cl.

*G03G 15/00* (2006.01)
*G03G 15/01* (2006.01)
*G03G 15/23* (2006.01)

(52) U.S. Cl.

CPC ..... *G03G 15/234* (2013.01); *G03G 2215/0135* (2013.01); *G03G 2215/00616* (2013.01); *G03G 15/5062* (2013.01)

USPC ..... 399/15; 399/49; 399/301

(58) Field of Classification Search

USPC ..... 399/15, 49, 301, 364

See application file for complete search history.

(56) References Cited

U.S. PATENT DOCUMENTS 5,488,458 A * 1/1996 Benedict et al. ..... 399/15
6,178,007 B1 * 1/2001 Harrington ..... 358/1.9
6,373,042 B1 * 4/2002 Kretschmann et al. .... 250/208.1
6,763,199 B2 * 7/2004 Conrow et al. ..... 399/15
7,257,358 B2 * 8/2007 Overall et al. ..... 399/301
7,420,719 B2 * 9/2008 Mongeon ..... 358/504
2005/0157317 A1 7/2005 Butterfield et al.
2006/0023057 A1 * 2/2006 Jung ..... 347/179
2006/0034631 A1 * 2/2006 Lofthus et al. ..... 399/84
2006/0067757 A1 * 3/2006 Anderson et al. ..... 399/341
2006/0121383 A1 * 6/2006 Zwartz et al. ..... 430/109.3
2006/0139433 A1 * 6/2006 Yoshida ..... 347/116
2007/0020550 A1 * 1/2007 Kamoto ..... 430/109.4
2007/0048652 A1 * 3/2007 Imahashi et al. ..... 430/111.33
2007/0098430 A1 * 5/2007 Hoffman et al. ..... 399/82
2007/0110465 A1 * 5/2007 Bonino et al. ..... 399/49
2007/0140721 A1 * 6/2007 Shinohara et al. ..... 399/72
2007/0189789 A1 * 8/2007 Suzuki ..... 399/49
2007/0196756 A1 * 8/2007 Shibai et al. ..... 430/108.1
2008/0030788 A1 2/2008 McElvain et al.
2008/0070134 A1 * 3/2008 Tada et al. ..... 430/32
2008/0175610 A1 * 7/2008 Gross et al. ..... 399/49
2008/0199194 A1 * 8/2008 Ishibashi ..... 399/49
2008/0227004 A1 * 9/2008 Yamaguchi et al. ..... 430/48
2008/0253782 A1 * 10/2008 Honguh ..... 399/45
2008/0278735 A1 * 11/2008 Wang et al. ..... 358/1.5
2009/0080921 A1 * 3/2009 Shimizu ..... 399/55
2009/0123866 A1 * 5/2009 Kawamura et al. ..... 430/137.14
2009/0162089 A1 * 6/2009 Ishibashi ..... 399/74
2010/0055597 A1 * 3/2010 Kamoto ..... 430/109.4
2010/0201061 A1 * 8/2010 Zirilli et al. ..... 271/225
2010/0226668 A1 * 9/2010 Swift et al. ..... 399/49
2010/0278543 A1 * 11/2010 Takizawa et al. ..... 399/9

(Continued)

OTHER PUBLICATIONS

Wikipedia article: "Tristimulus colorimeter" dated Oct. 19, 2009, multiple authors/sources.*

*Primary Examiner* — David Bolduc

(57) ABSTRACT

A method for measuring Side 1 to Side 2 image on paper misregistration includes using a series of lines printed on both sides of a substrate, such as, paper. The paper is passed in front of an in-line spectrophotometer or densitometer. The amount of image "show through" is measured and correlated to an amount of misregistration.

8 Claims, 2 Drawing Sheets

(56) References Cited

U.S. PATENT DOCUMENTS

2010/0329756 A1 12/2010 Mizes
2011/0052228 A1* 3/2011 Kozitsky et al. ..... 399/49
2011/0135330 A1* 6/2011 Honguh ..... 399/45
2011/0205568 A1* 8/2011 Moalem et al. ..... 358/1.9
2011/0217052 A1* 9/2011 Usui et al. ..... 399/15
2012/0057885 A1* 3/2012 Paul et al. ..... 399/15

* cited by examiner

METHOD OF CORRELATING IMAGE MISREGISTRATION

BACKGROUND

1. Field of the Disclosure

This disclosure relates in general to an image forming apparatus, such as a printer, and more particularly, to an image forming apparatus employing an improved approach to measuring side 1 to side 2 image misregistration.

2. Description of Related Art

Printers provide fast, reliable, and automatic reproduction of images. The word "printer" as used herein encompasses any apparatus, such as a digital copier, book marking machine, facsimile machine, multi-function machine, etc., which performs a print outputting function for any purpose. Printing features that may be implemented in printers include the ability to do either full color or black and white printing, and printing onto one (simplex) or both sides of the image substrate (duplex). The image substrate can be either cut sheet or web fed.

Color misregistration has been addressed in the past. For example, a system and method for detecting and correcting color misregistration errors in a color image forming device is shown in U.S. Patent Application Publication No. U.S. 2005/0157317 A1, now abandoned. Spectrophotometric analysis is performed on special color registration patches to transform color registration errors into a color signal. The color registration patch is designed so the color shift detected by the spectrophotometer allows prediction of the amount of color misregistration. In U.S. Patent Application Publication No. U.S. 2008/0030788 A1, now U.S. Pat. No. 8,274,717, a system and method is provided for characterizing color separation misregistration associated with marking a substrate. The method includes providing an input image having a plurality of patches, each patch having a pattern using a first and second color; marking a substrate with a copy of the input image suing a first and second color separation to correspond to the first and second colors, respectively; and measuring a color characteristic of marking of respective copied patches of the copied plurality of patches and generating corresponding colorimetric values. Misregistration of the first color separation markings relative to the second color separation markings is characterized based on the measured colorimetric values. A method for using image show-through for measuring front and back image registration that relies on a full width array sensor and printed registration marks is shown in U.S. Patent Application Publication No. U.S. 2010/0329756, now allowed. All of the heretofore mentioned references, and their references, are included herein by reference.

While these heretofore mentioned color misregistration techniques have been useful, they do not address the problem encountered measuring Side 1 to Side 2 image on paper (IOP) misregistration. Current methods for measuring Side 1 to Side 2 IOP misregistration involve using an eye loupe, off-line scanner, or in-line scanner. A manual measurement is both time consuming and involves human error. A scanner solution is expensive and the image processing can be complicated.

Hence, there is still a need for a simple method that will allow one to easily measure Side 1 to Side 2 IOP misregistration.

BRIEF SUMMARY

Accordingly, and in answer to the above-mentioned problem, a method for measuring Side 1 to Side 2 IOP misregistration includes using a series of lines printed on both sides of a substrate, such as, paper. The paper is passed in front of an in-line spectrophotometer or densitometer. The amount of image "show through" is measured and correlated to the amount of misregistration.

The disclosed reprographic system that incorporates the disclosed improved method for measuring Side 1 to Side 2 IOP misregistration in a printer may be operated by and controlled by appropriate operation of conventional control systems. It is well-known and preferable to program and execute imaging, printing, paper handling, and other control functions and logic with software instructions for conventional or general purpose microprocessors, as taught by numerous prior patents and commercial products. Such programming or software may, of course, vary depending on the particular functions, software type, and microprocessor or other computer system utilized, but will be available to, or readily programmable without undue experimentation from, functional descriptions, such as, those provided herein, and/or prior knowledge of functions which are conventional, together with general knowledge in the software of computer arts. Alternatively, any disclosed control system or method may be implemented partially or fully in hardware, using standard logic circuits or single chip VLSI designs.

The term 'sheet' herein refers to any flimsy physical sheet or paper, plastic, or other useable physical substrate for printing images thereon, whether precut or initially web fed.

As to specific components of the subject apparatus or methods, or alternatives therefor, it will be appreciated that, as normally the case, some such components are known per se' in other apparatus or applications, which may be additionally or alternatively used herein, including those from art cited herein. For example, it will be appreciated by respective engineers and others that many of the particular components mountings, component actuations, or component drive systems illustrated herein are merely exemplary, and that the same novel motions and functions can be provided by many other known or readily available alternatives. All cited references, and their references, are incorporated by reference herein where appropriate for teachings of additional or alternative details, features, and/or technical background. What is well known to those skilled in the art need not be described herein.

BRIEF DESCRIPTION OF THE DRAWINGS

Various of the above-mentioned and further features and advantages will be apparent to those skilled in the art from the specific apparatus and its operation or methods described in the example(s) below, and the claims. Thus, they will be better understood from this description of these specific embodiment(s), including the drawing figures (which are approximately to scale) wherein:

Figure 1:
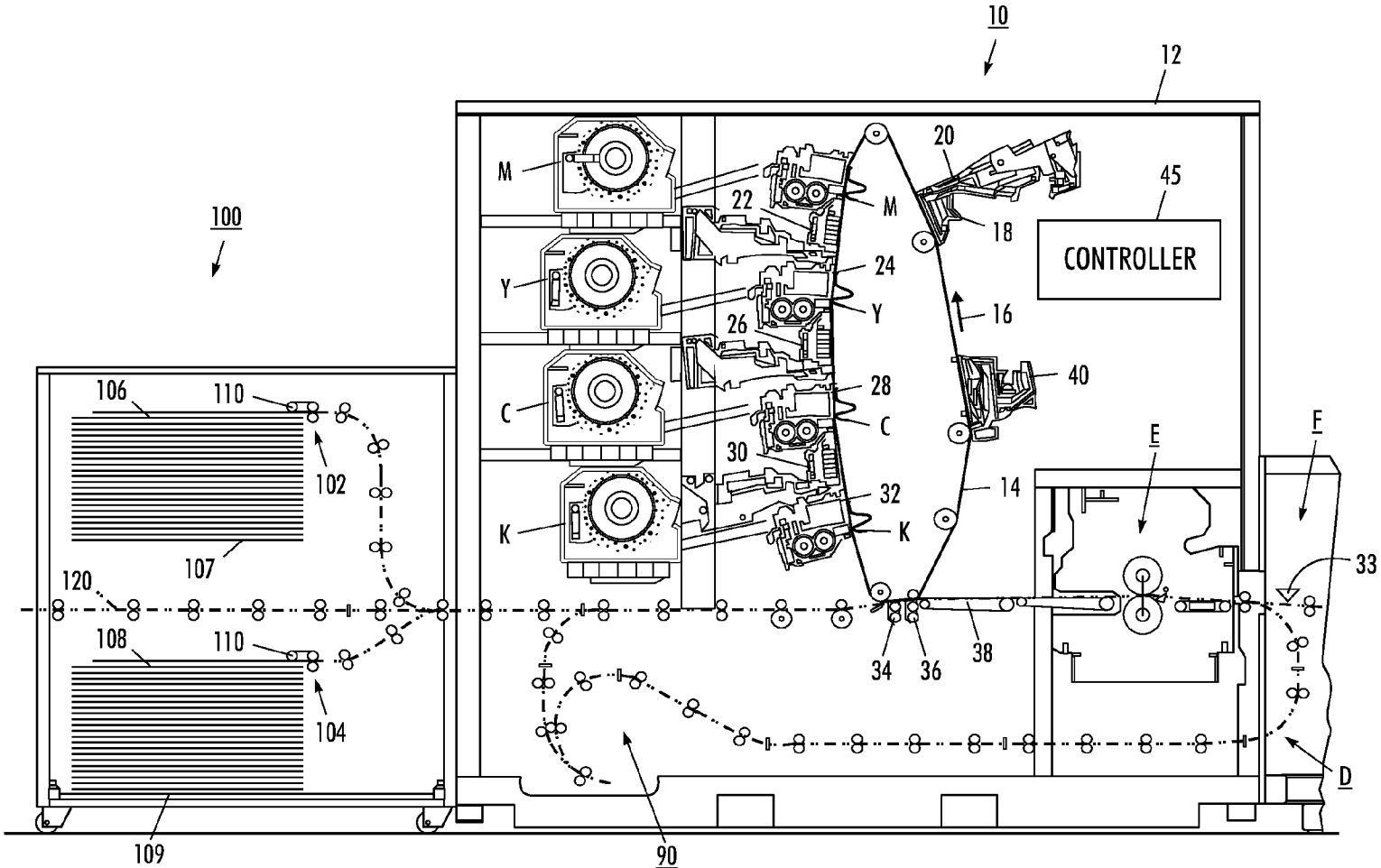
FIG. 1 is a frontal view of an exemplary image forming apparatus that incorporates the improved Side 1 to Side 2 image registration method and apparatus of the present disclosure.

While the disclosure will be described hereinafter in connection with a preferred embodiment thereof, it will be understood that limiting the disclosure to that embodiment is not intended. On the contrary, it is intended to cover all alternatives, modifications and equivalents as may be included within the spirit and scope of the disclosure as defined by the appended claims.

The disclosure will now be described by reference to a preferred embodiment xerographic printing apparatus that includes a method and apparatus for measuring Side 1 to Side 2 IOP misregistration.

For a general understanding of the features of the disclosure, reference is made to the drawings. In the drawings, like reference numerals have been used throughout to identify identical elements.

Referring now to printer 10 in FIG. 1 which, as in other xerographic machines, and as is well known, shows an electrographic printing system including the improved method and apparatus where Side 1 to Side 2 IOP misregistation is measured in the printer by printing and measuring a series of patches on paper to maintain the printer performance in accordance with the present disclosure. Marking module 12 includes a charge retentive substrate which could be a photoreceptor belt 14 that advances in the direction of arrow 16 through the various processing stations around the path of belt 14. Charger 18 charges an area of belt 14 to a relatively high, substantially uniform potential. Next, the charged area of belt 14 passes laser 20 to expose selected areas of belt 14 to a pattern of light, to discharge selected areas to produce an electrostatic latent image. Next, the illuminated area of the belt passes developer unit M, which deposits magenta toner on charged areas of the belt.

Subsequently, charger 22 charges the area of belt 14 to a relatively high, substantially uniform potential. Next, the charged area of belt 14 passes laser 24 to expose selected areas of belt 14 to a pattern of light, to discharge selected areas to produce an electrostatic latent image. Next, the illuminated area of the belt passes developer unit Y, which deposits yellow toner on charged areas of the belt.

Subsequently, charger 26 charges the area of belt 14 to a relatively high, substantially uniform potential. Next, the charged area of belt 14 passes laser 28 to expose selected areas of belt 14 to a pattern of light, to discharge selected areas to produce an electrostatic latent image. Next, the illuminated area of the belt passes developer unit C, which deposits cyan toner on charged areas of the belt.

Subsequently, charger 30 charges the area of belt 14 to a relatively high, substantially uniform potential. Next, the charged area of belt 14 passes laser 32 to expose selected areas of belt 14 to a pattern of light, to discharge selected areas to produce an electrostatic latent image. Next, the illuminated area of the belt passes developer unit K, which deposits black toner on charged areas of the belt.

As a result of the processing described above, a full color toner image is now moving on belt 14. In synchronism with the movement of the image on belt 14, a conventional registration system receives copy sheets from sheet feeder module 100 and brings the copy sheets into contact with the image on belt 14. Sheet feeder module 100 includes high capacity feeders 102 and 104 and include sheet separation modules 110, respectively, that feed sheets from sheet stacks 106 and 108 positioned on media supply trays 107 and 109 and directs them along sheet path 120 to imaging or marking module 112. Additional high capacity media trays could be added to feed sheets along sheet path 120, if desired.

A corotron 34 charges a sheet to tack the sheet to belt 14 and to move the toner from belt 14 to the sheet. Subsequently, detack corotron 36 charges the sheet to an opposite polarity to detack the sheet from belt 14. Prefuser transport 38 moves the sheet to fuser E, which permanently affixes the toner to the sheet with heat and pressure. The sheet then passed a spectrophotometer 33 for used in maintaining color consistency and advances to stacker module F, or to duplex loop D.

Cleaner 40 removes toner that may remain on the image area of belt 14. In order to complete duplex copying, duplex loop D feeds sheets back for transfer of a toner powder image to the opposed sides of the sheets. Duplex inverter 90, in duplex loop D, inverts the sheet such that what was the top face of the sheet, on the previous pass through transfer, will be the bottom face on the sheet, on the next pass through transfer. Duplex inverter 90 inverts each sheet such that what was the leading edge of the sheet, on the previous pass through transfer, will be the trailing on the sheet, on the next pass through transfer.

With further reference to FIG. 1 and in accordance with the present disclosure, a simple method and apparatus for measuring relative Side 1 to Side 2 IOP misregistration using a spectrophotometer or densitometer in printer 10 is disclosed that includes an algorithm and an optical sensor 33 for measuring pattern show-through from images printed on both sides of a sheet. As shown, the optical sensor 33 is a conventional spectrophotometer or densitometer and is used to send signals back to controller 45.

Figure 2:
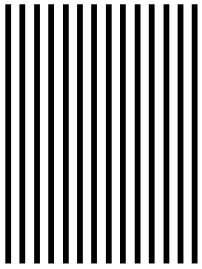
FIG. 2 is partial plan view showing parallel lines printed on each side of paper.
Figure 3A:
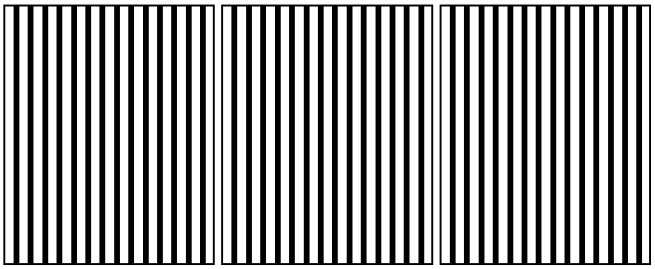
FIG. 3A is a plan view showing a three patch series printed on Side 1.
Figure 3B:
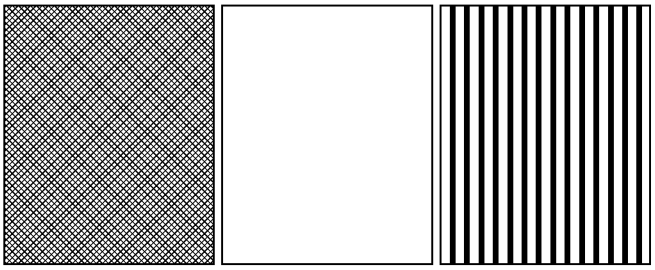
FIG. 3B is a plan view showing a three patch series printed on Side 2.

The method of the present disclosure includes providing parallel lines similar to the ones shown in FIG. 2 printed on both sides of white paper. Only one printed color is required for IOP measurements. Therefore, black should be used since it has the highest contrast from white paper. If Side 1 and Side 2 images are perfectly registered to one another, the lines coincide and no "show though" exists. When the Side 1 and Side 2 images are misregistered by one line width, then the maximum "show though" exists and the measurement with spectrophotometer 33 decreases in L*. Tests have shown that signal levels for two side coated Xerox DC Elite gloss 120 gsm have contrast 1.3 dE CIE between maximum show through and minimum show through. For uncoated Xerox 4200 75 gsm, the contrast is 2.3 dE CIE. The maximum contrast can be measured real time by printing parallel lines on Side 1 moving to the right in FIG. 3A and coincident solid black area on Side 2 shown in FIG. 3B for one measurement followed by parallel lines on Side 1 and an undeveloped area on Side 2 for a second measurement. For a third coincident measurement, parallel lines are printed on both Side 1 and Side 2. The level of spectrophotometer signal of the third measurement compared to the first and second can be used to calculate the Side 1 to Side 2 misregistration. All measurements are measured on Side 1. Parallel lines may be printed aligned with the process direction, cross process direction or 45 degrees to each in order to achieve measurement of misregistration in various directions. The size of the sensing aperture is a minimum of two line widths, but can be larger for increased signal to noise ratio, if desired.

It should be understood that the signal can be measured in units of dE, dL*, density units, or others, and the measurement device can be a spectrophotometer, a reflective-type densitometer, a transmissible type densitometer, or others optical sensing device. And since in-line sensing is fast and patch size is 5 mm to 10 mm, several patches can be printed and measured and the results averaged, in order to increase the signal to noise ratio. Furthermore, the images can be printed and signals averaged across multiple pages, if desired. In addition, the method and apparatus can also be used to measure Side 1 to Side 2 registration on a continuous feed printer with patches printed on non-image areas.

In recapitulation, a method and apparatus has been disclosed that includes measuring the "show through" from Side 1 to Side 2 of a printed page for the purpose of an image-on-paper registration set-up. It has been found that measurable changes occur in dE, L* and optical density as the alignment between Side 1 and Side 2 line patterns change. This method includes the use of an existing sensor in the machine to measure a critical to customer image quality attribute so that appropriate adjustments can be applied as needed. The method and apparatus can be used with color or black images.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A method for measuring Side 1 to Side 2 image misregistration, comprising:

printing parallel lines on Side 1 and solid black on Side 2 of a sheet;

measuring any show through of Side 1 relative to Side 2 for a first measurement;

printing parallel lines on Side 1 and an undeveloped area on Side 2 of the sheet;

measuring any show through of Side 1 relative to Side 2 for a second measurement;

printing parallel lines on both Side 1 and Side 2 of the sheet;

measuring any show through of Side 1 relative to Side 2 for a third measurement; and comparing said third measurement to said first and second measurements to calculate Side 1 and Side 2 misregistration.

2. The method of claim 1, including providing said measurements with an optical sensor.

3. The method of claim 2, wherein said optical sensor is a spectrophotometer.

4. The method of claim 1, wherein said optical sensor is a densitometer.

5. The method of claim 4, wherein said densitometer is a reflective-type densitometer.

6. The method of claim 4, wherein said densitometer is a transmissive-type densitometer.

7. The method of claim 1, wherein said method is incorporated into a xerographic device.

8. The method of claim 1, including providing a three patch series on Side 1 and a three patch series on Side 2 of said sheet.

* * * * *